United States Patent [19]

Shapiro

[11] 4,335,846

[45] Jun. 22, 1982

[54] THREE-PHASE DECANTER

[75] Inventor: Leonard Shapiro, Upper Darby, Pa.

[73] Assignee: Pennwalt Corporation, Philadelphia, Pa.

[21] Appl. No.: 225,273

[22] Filed: Jan. 15, 1981

[51] Int. Cl.[3] ..... B04B 1/20; B04B 7/00

[52] U.S. Cl. ..... 233/7; 233/39; 233/41; 233/47 R

[58] Field of Search ..... 233/3, 4, 7, 16, 17, 233/41, 19 R, 19 A, 20 A, 21, 22, 38, 46, 47 R, 39

[56] References Cited

U.S. PATENT DOCUMENTS

| | | | |
|---|---|---|---|
| 2,703,676 | 3/1955 | Gooch | 233/7 |
| 3,248,323 | 4/1966 | Albertson | 233/7 X |
| 3,348,767 | 10/1967 | Ferney | 233/7 |
| 3,934,792 | 1/1976 | High et al. | 233/7 |
| 4,303,200 | 12/1981 | Hansen | 233/47 R X |

*Primary Examiner*—Harvey C. Hornsby
*Assistant Examiner*—Joseph M. Pitko

[57] ABSTRACT

A 3-phase centrifugal decanter separates a mixture of a light liquid phase, a heavy liquid phase, and solids. The decanter employs two types of dam holders, each carrying a substantially similar dam capable of passing either liquid phase therethrough depending upon the type holder carrying the dam. By mounting the holders with their dams to prepositioned openings provided in a front-located hub, both liquid phases are caused to be discharged through the hub to specified compartments. The two types of holders are capable of being mounted interchangeably to the hub openings. Dams are interchangeable in the holders. By interchanging the positions of the holders, each liquid phase may now be directed to the other's compartment. The holder carrying the dam for discharging heavy liquid phase cooperates with an underdam which prevents light liquid phase from passing through or therearound.

21 Claims, 5 Drawing Figures

THREE-PHASE DECANTER

STATEMENT OF THE INVENTION

This invention relates to centrifugal decanters and more particularly to such decanters for continuously separating a heavy liquid phase, a light liquid phase, and solids—from a mixture thereof.

BACKGROUND AND SUMMARY OF THE INVENTION

Conventionally, a 3-phase decanter comprises an elongated bowl mounted for rotation about its longitudinal axis. Coaxially mounted within the bowl is a helical screw conveyor adapted to rotate at a speed slightly different than the speed of the bowl. The bowl is usually tapered at its rear or solids discharge end.

Feed is introduced into the bowl. Due to centrifugal force effected by rotation of the bowl, the feed separates into its component members. Since the bowl and helical screw conveyor are caused to rotate at controlled different speeds, solids sedimented against the bowl wall are conveyed along the inner annular surface thereof to solids discharge openings provided at the tapered end of the bowl.

Various means exist for discharging separated liquids from the bowl. Several such means are disclosed in U.S. Pat. No. 3,623,656, assigned to the assignee hereof.

The present invention discloses a three-phase centrifugal decanter which comprises readily interchangeable members for controllably directing the separated liquids into specific compartments depending upon the windage patterns prevailing in the rotating decanter bowl and flow rates of the respective liquids being separated.

DETAILED DESCRIPTION OF THE INVENTION

Figure 1:
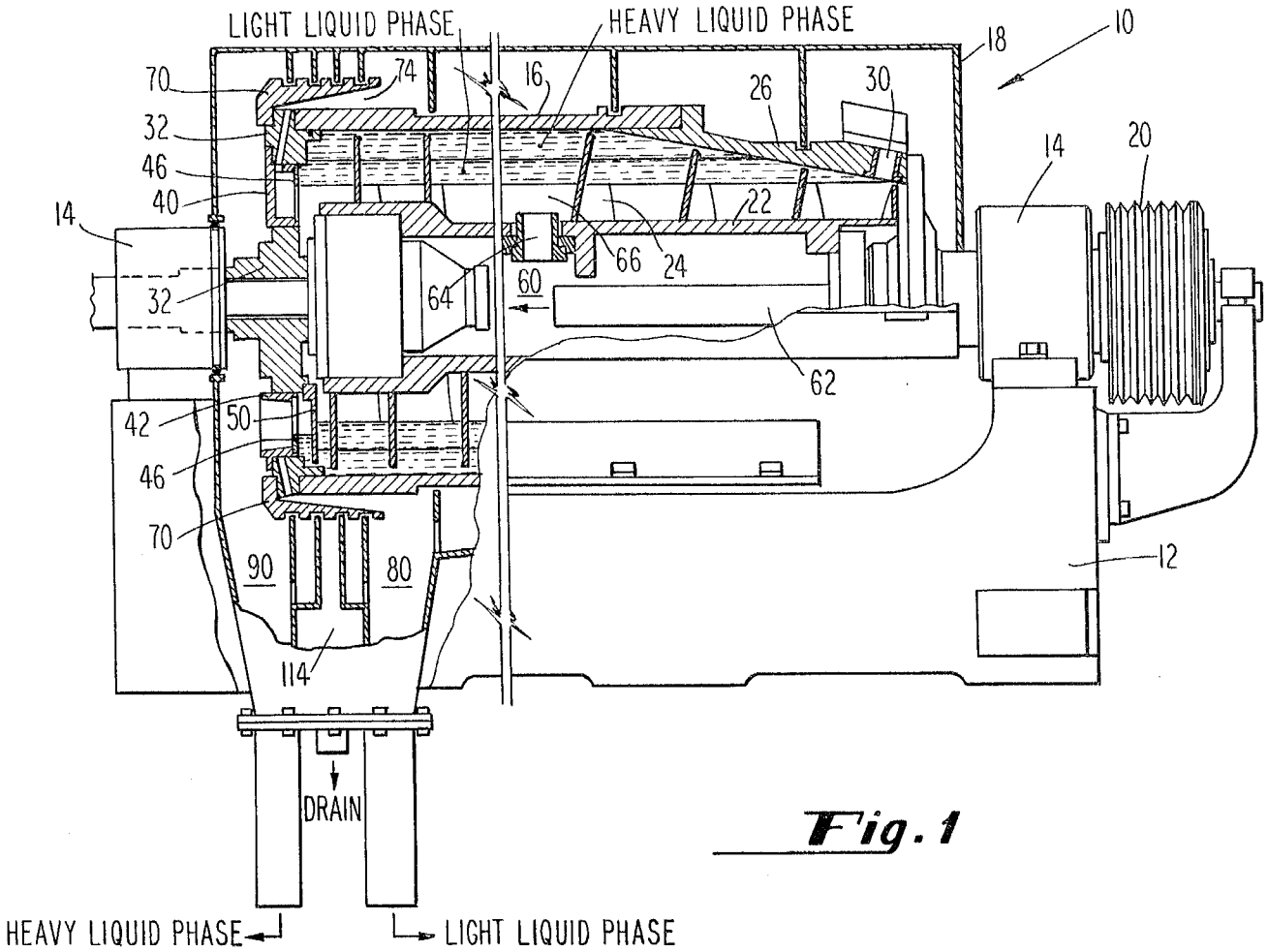
FIG. 1 is an elevational view of a 3-phase decanter, portions broken away in section, illustrating a preferred embodiment of the present invention.

In FIG. 1, a 3-phase decanter 10 includes a frame 12 having bearings 14 into which are journaled the ends of a hollow, elongated centrifuge bowl 16 of circular cross-section. Bowl 16 rotates about its longitudinal axis within housing 18. Bowl 16 is typically belt driven by a motor (not shown), the belt extending around pulley 20. Bowl 16 rotates at speeds capable of generating a centrifugal force several thousand times greater than the force of gravity. Disposed within bowl 16, and mounted coaxially therewith, is a helical screw conveyor 22 adapted to rotate at a speed slightly different than that of bowl 16 by suitable means (not shown), typically a gear box having torque control means and a spline shaft within the bowl shaft connected to conveyor 22.

Helical screw conveyor 22 includes coiled screw flights 24, the distal edges thereof generally complementing the inside contour of bowl 16, but spaced a short distance therefrom to provide some clearance therebetween.

Bowl 16 is provided with a tapered or convergent portion 26 terminating in an end wall or rear wall 28. Symmetrically arranged around tapered portion 26 is a group of solids discharge openings 30.

Figure 3:
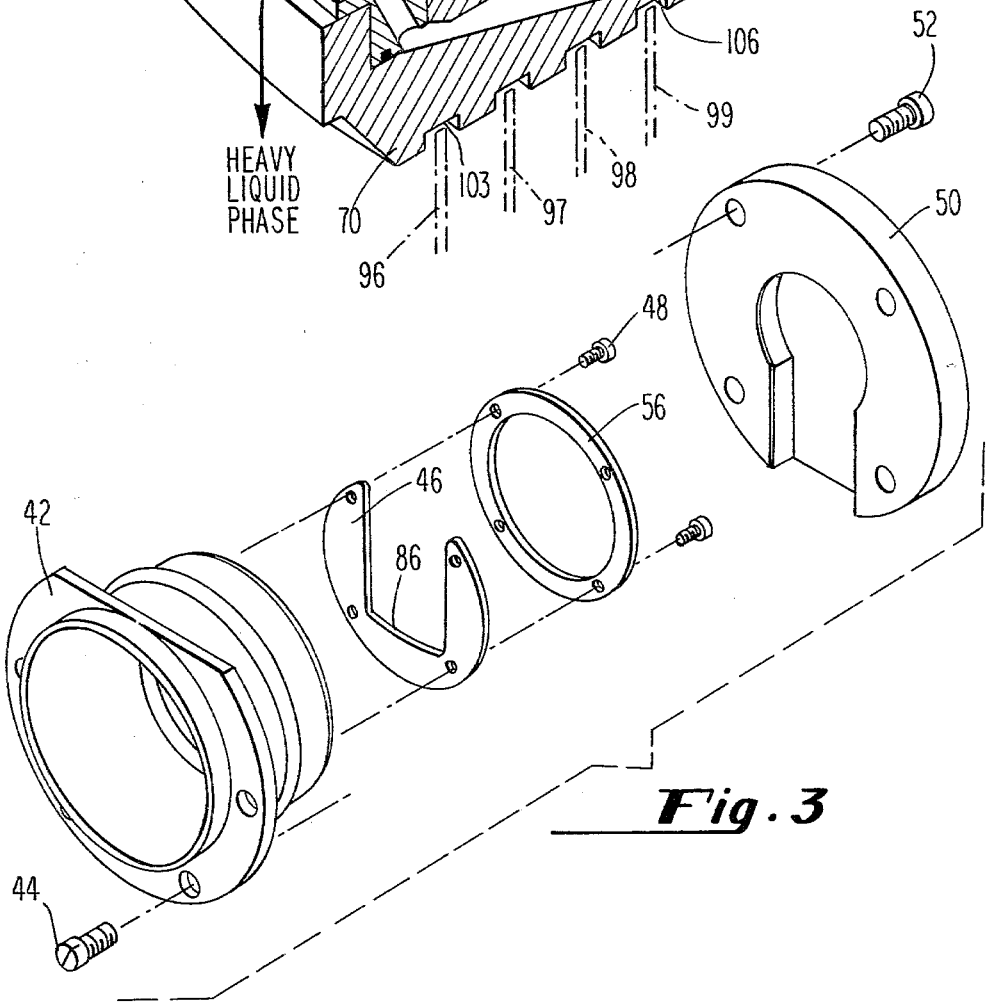
FIG. 3 is an exploded perspective view of a portion of structure illustrated in FIG. 2.

Referring additionally to the remainder of the drawings, the front end of bowl 16 is provided with a hub member 32 supported within main bearing 14. Hub 32 may readily be separated from bowl 16 by simply removing bolts (not shown) adjacent periphery of the hub. A plurality of dam holders are mounted within spaced openings provided symmetrically uniformly in hub 32. More specifically, light liquid phase dam holders 40 and heavy liquid phase dam holders 42 are mounted in alternate, 60° spaced apart symmetrical relationship about the face of hub 32, and are removably secured to hub 32 by means of bolts 44. Each dam holder 40 and 42 retains a substantially similar dam member 46 by means of screws 48. Each dam member 46 may be interchangeably mounted to either type dam holder. Underdams 50, adjacent heavy liquid phase dam holders 42 (FIG. 4) are mounted to hub 32 by bolts 52 (FIG. 3). Underdams 50 are required wherever heavy liquid phase is being discharged and are disposed interiorly of dams 46. Various gaskets 56 and O-rings 58 are provided as shown to prevent leakage of either liquid phase.

Figure 4:
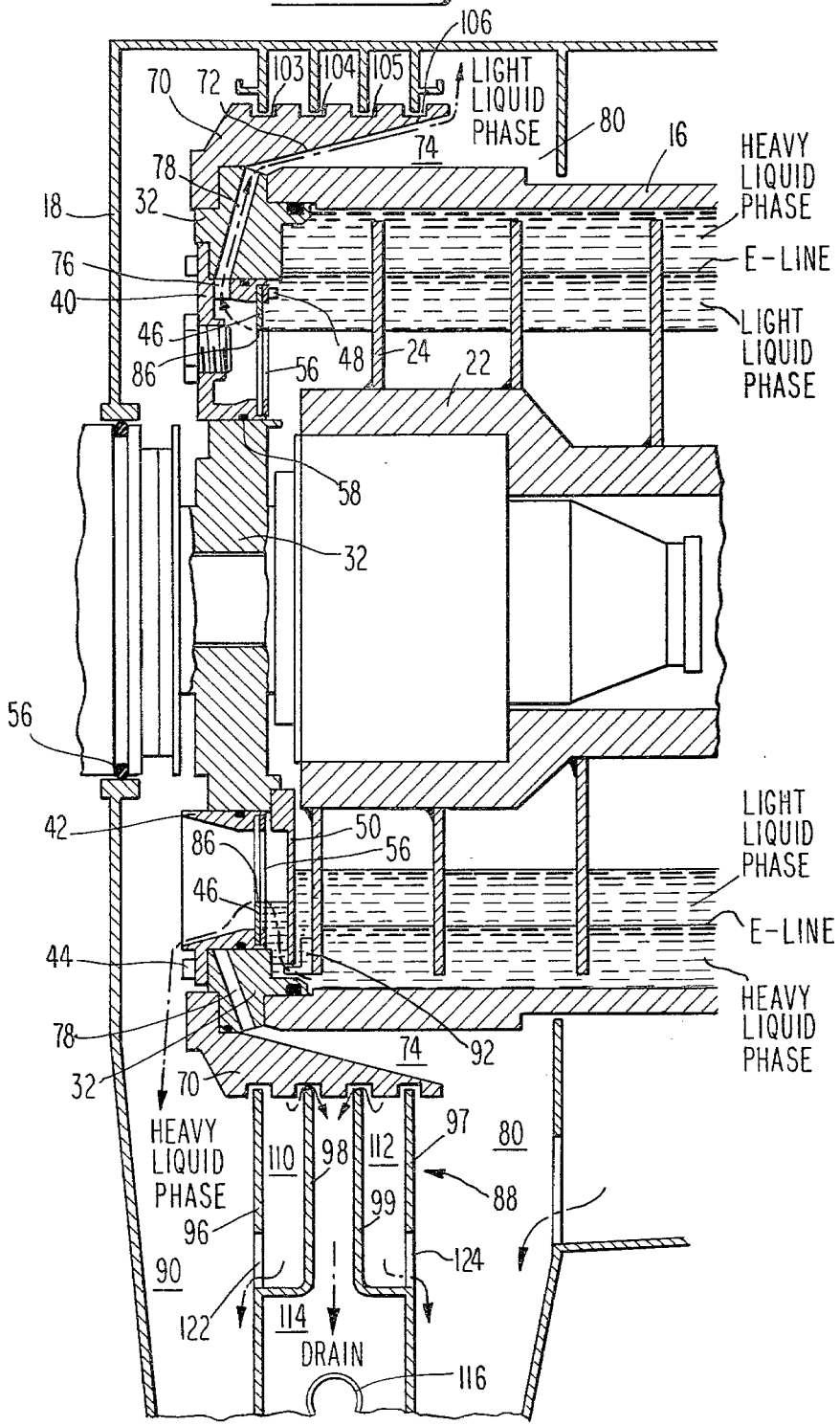
FIG. 4 is an enlarged view of the front portion of the decanter shown in FIG. 1.
Figure 5:
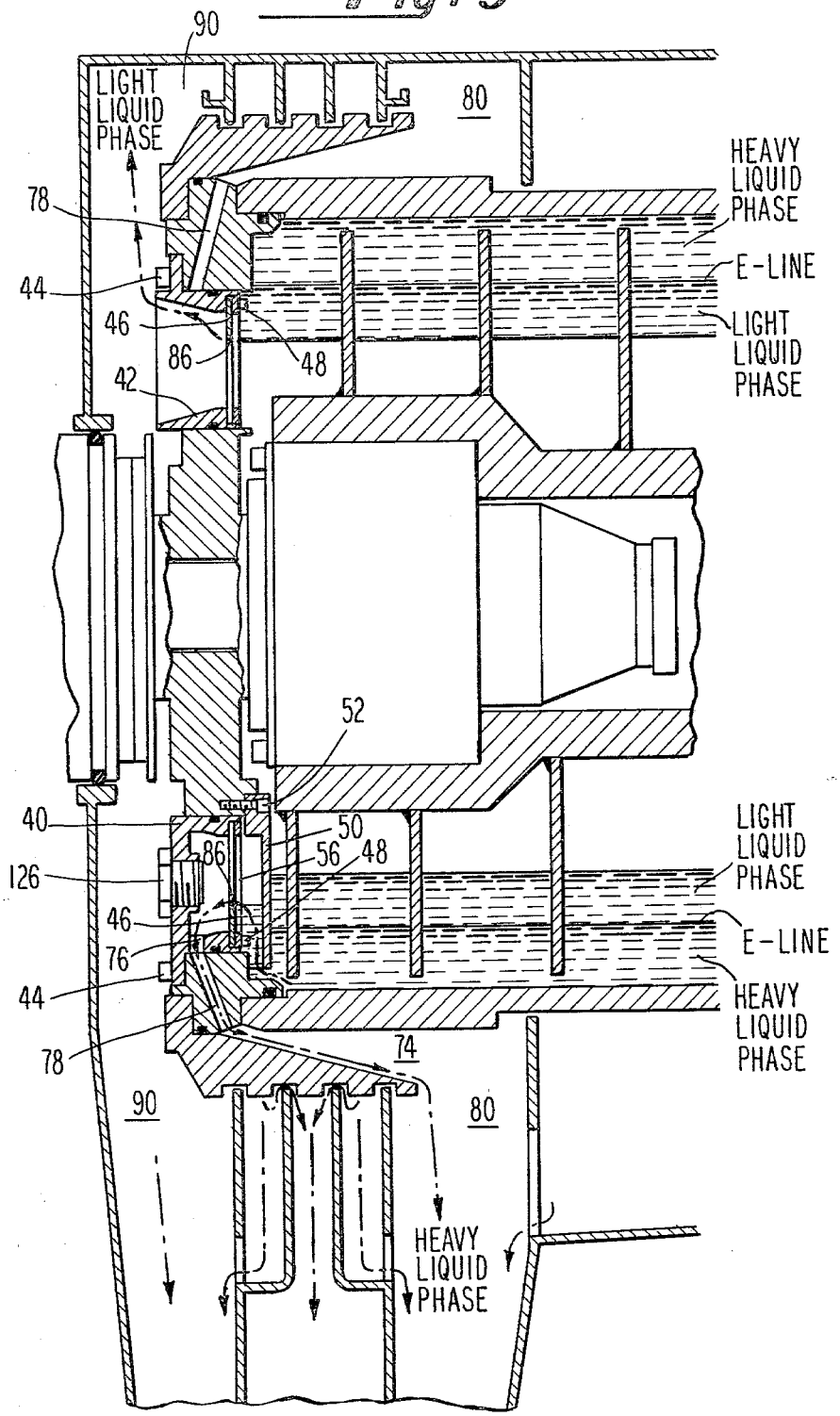
FIG. 5 is a view similar to FIG. 4 illustrating interchangeability of dam holders with resultant reversal in location of discharges of heavy and light liquid phases.

In the embodiment of FIG. 5, light liquid phase dam holder 40 has been interchanged with heavy liquid phase dam holder 42 of FIG. 4, and is illustrated passing heavy liquid phase therethrough. Nevertheless, for clarity of description, the dam holder 40, as configured, has been referred to, and is hereinafter referred to, as the light liquid phase dam holder. Similarly, holder 42 is referred to as the heavy liquid phase dam holder.

The invention is not intended to be limited to alternating light and heavy liquid phase dam holders disposed at 60° intervals around hub 32. If the primary liquid, i.e., the liquid having the higher flow rate is the heavy liquid phase, for example (FIG. 4), then four of the dams may be heavy liquid phase dam holders with the remaining two dams discharging the light liquid phase. Conversely, the dam holder arrangement will be reversed when the light liquid phase has the higher flow rate (FIG. 5). Similarly, hub 32 may carry a greater or lesser number of dam holders, depending upon, for example, the size of the hub and decanter, feed rate, size of openings of the dam members, and the like.

Helical screw conveyor 22, being hollow, defines an area therewithin designated feed chamber 60 (FIG. 1). The process feed stream, or liquids-solids mixture to be separated, is introduced into feed chamber 60 through an axially extending feedpipe 62. The mixture is next delivered through a plurality of radial passages 64 disposed within helical screw conveyor 22 into a separation chamber 66.

Screw mounted to the periphery of hub member 32 is an annular flange 70 having an inner annular surface 72 which diverges as it extends away from the front end of the decanter. An annular zone 74 is thus defined by the outer surface of bowl 16 and divergent surface 72. Zone 74 communicates with the discharging light liquid phase (FIG. 4) through openings 76 in light liquid phase dam holders 40 and bores 78 provided in the outer portions of hub 32. Zone 74 then leads into light liquid phase compartment 80.

As bowl 16 rotates, the two immiscible liquids contained therewithin separate into concentric pools, the heavier liquid phase migrating toward the bowl wall while the lighter liquid phase migrates inwardly, or toward the center of axis of rotation of the bowl, as indicated in FIGS. 1, 4 and 5. The heavy solid phase migrates outwardly, settling on the inside wall of bowl 16.

The position of the E-line, i.e. the line where the two liquid phases meet, is fixed during rotation of the bowl. The E-line position is a function of the specific gravities of the liquids being separated and the size, shape and relative radial positioning of the weir surfaces 86 of the openings of dams 46 carried by dam holders 40 and 42. It is appreciated that dams 46 may be fabricated with an assortment of varying sizes of openings 86 to accommodate specific applications. Thus, since the exact position of the E-line can be controlled, the volume of each phase in the bowl is controlled; therefore the residence time of each phase available to allow separation is also controlled. Thus the bowl can be divided to contain any desired proportion of light or heavy phase as each application requires.

A labyrinth structure 88, later described, insures even further purity of the discharged phases.

Figure 2:
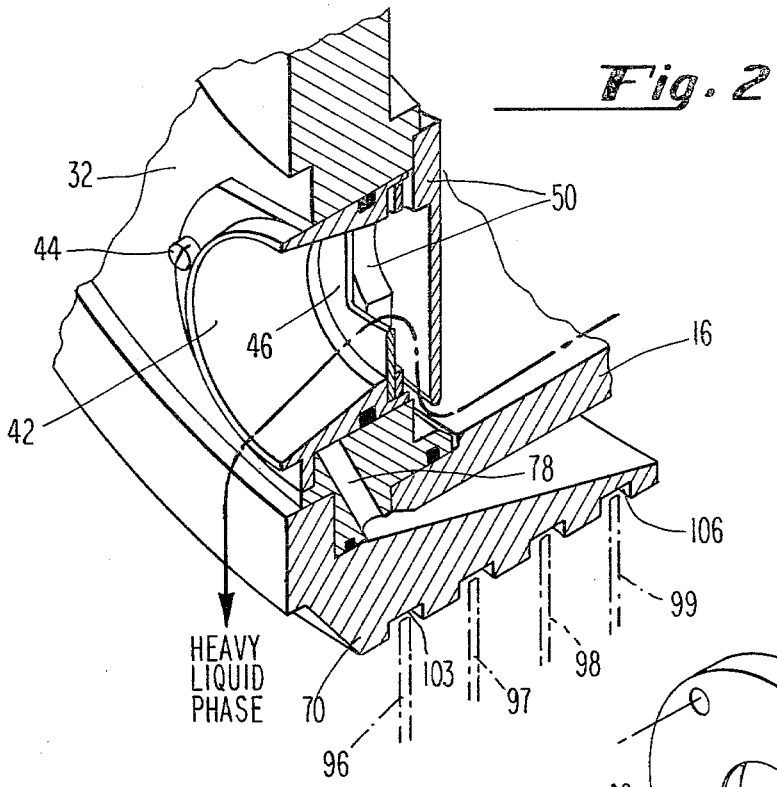
FIG. 2 is a fragmentary perspective view of a portion of the decanter of FIG. 1 illustrating a heavy liquid phase dam holder and components associated therewith.

Referring particularly to FIG. 4, the light liquid phase is prevented from discharging through any of the heavy liquid phase dam holders 42 because of the presence of underdams 50. The flow of heavy liquid phase, however, indicated by the broken lines, passes outwardly of underdams 50 and then inwardly, to exit dam openings 86 and into heavy liquid phase compartment 90. The heavy liquid phase is prevented from entering bores 78 by virtue of the construction of the heavy liquid phase dam holders 42 (FIG. 2).

A scraper member or tab 92 is affixed to helical screw conveyor 22 at a distal portion of the forward-most flight 24. Upon rotation of screw conveyor 22, tab 92 sweeps outwardly of underdams 50 to remove any solids sedimented or accumulated thereat to effectively prevent any plugging, and insuring the proper free flow of heavy liquid phase. The loosened solids are conveyed by conveyor 22 towards the rear of bowl 16 and through solids discharge openings 30 or are carried out with the heavy liquid phase.

Heavy liquid phase compartment 90 and light liquid phase compartment 80 are formed, in part, by stationary annular partitions or baffles 96 and 97 respectively (FIG. 4). Baffles 96 and 97 also comprise the outer members of labyrinth structure 88 which includes additional stationary annular baffles 98 and 99. Baffles 96, 97, 98 and 99 are secured to housing 18 and respectively extend inwardly toward annular grooves 103, 104, 105 and 106 provided around flange 70. The baffles are not in contact with the grooves and thus provide spaces therebetween for passage of air and aerosols, later described.

Inner baffles 98 and 99 are curved in opposite directions at their lower portions (FIG. 4) to respectively provide a heavy liquid phase vapor chamber 110 and a light liquid phase vapor chamber 112, as well as a central chamber 114. Central chamber 114 houses pipe 116 therein (FIG. 4) and also serves as a conduit for draining contaminated or commingled vapors and/or aerosols, or condensates thereof, of the heavy and light phases to drain. Pipe 116 functions as a vent, or alternatively, to introduce air into central chamber 114 for urging vapors and/or aerosols, including condensate and escaped liquid, back into their respective chambers and through openings 122 and 124 provided in baffles 96 and 97. Heavy and light liquid phases are suitably discharged as indicated (FIG. 1).

With a typical rotor speed of about 3250 rpm, windage patterns within the decanter housing are not predictable, and aerosols of the respective phases formed at these high rotor speeds may cross over to another compartment to contaminate the liquid phase contained therein.

In most specific applications, however, there is a desire for one of the two liquid discharge phases to be as pure as possible. Therefore, wind should be caused to flow into that compartment where purity of its liquid phase is of lesser importance. The labyrinth structure above described, cooperating with structure aforedescribed which permits the ready interchanging of dam holders in the hub to thereby direct the discharge of one of the liquid phases into a desired compartment, provide optimum separation of the liquids and significantly reduce cross-contamination.

In FIG. 5, the window pattern and primary liquid flow dictate the discharge of heavy liquid phase into compartment 80, heretofore designated the light liquid phase compartment. Thus, heavy liquid phase dam holder 42, now shown at the upper portion of FIG. 5, discharges light liquid phase therethrough, after passing over weir surface 86 of dam 46. The construction of heavy liquid phase dam holder 42 prevents the light liquid phase from entering bore 78, and hence, the light liquid phase is discharged into compartment 90 referred to as the heavy liquid phase compartment (FIG. 4).

Conversely, at the site of the light liquid phase dam holder 40, the heavy liquid phase, as indicated by the broken lines, passes outwardly of underdam 50, over weir surface 86 of dam 46, through opening 76 of light liquid phase dam holder 40, into bore 78 and zone 74, and finally into compartment 80.

Threaded lugs 126 are screw mounted to light liquid phase dam holders 40 for providing easy access to the interiors thereof for purposes of cleaning, and the like.

Summarizing, a 3-phase decanter is provided wherein the dam members thereof may easily be interchanged or replaced by others having desired opening sizes to provide relatively low cresting effects to thereby maintain stable flow substantially independent of flow rate of the specific liquid phases being separated. The dam holders which carry the dam members are capable of being readily interchangeably positioned within the centrifuge to thus cause either liquid phase to be directed into a desired compartment in accordance with windage patterns and flow rates. All discharge passages for the heavy and light phases are disposed an adequate distance apart to thereby reduce the possibility of cross-contamination of the liquids. The entire bowl is swept by the conveyor flights and single scraper member attached thereto in order to effectively eliminate any areas within the centrifuge wherein solids may collect to thereby insure free discharge flow of liquids. Further, the vented labyrinth structure between the light and heavy liquid phase discharges insures minimal intercover leakage and thereby maintains the purity of the two liquid phases produced by the high gravitational field in the bowl.

I claim:

1. In a 3-phase decanter for separating solids, a light liquid phase, and a heavy liquid phase, from feed comprising a liquids-solids mixture fed into a bowl of said decanter mounted for rotation and including screw means cooperating with means for rotating said bowl for conveying said solids from said mixture out a rear portion of said bowl, the improvement comprising a hub at a front portion of said decanter mounted for rotation with said bowl, said hub having a plurality of spaced openings therethrough, detachable holding means mounted to each of said openings and comprising at least one light liquid phase dam holder and at least one heavy liquid phase dam holder, each of said holding means adapted to pass one of said liquid phases therethrough, dam means having a cut-out passageway, one of said dam means carried by each of said holding means, said cut-out passageways controlling flow of one of said liquid phases therethrough in accordance with type holding means carrying said dam means, underdams mounted between said liquid phase and said dam holders positioned for passage of said heavy liquid phase therethrough, said underdams passing said heavy liquid phase therearound and blocking passage of said light liquid phase, and bore means disposed in said hub outwardly from said hub openings cooperating with each of said holding means for discharging said liquid phase passing through said holding means cooperating therewith.

2. Apparatus of claim 1 wherein said hub openings are symmetrically disposed about rotational axis of said bowl and hub.

3. Apparatus of claim 2 wherein said holding means comprises an equal number of said light liquid phase dam holders and said heavy liquid phase dam holders.

4. Apparatus of claim 3 wherein said light liquid phase dam holders are interchangeably mounted with said heavy liquid phase dam holders in said hub openings.

5. Apparatus of claim 2 wherein said light liquid phase has a higher flow rate than said heavy liquid phase and the number of said light liquid phase dam holders is greater than number of said heavy liquid phase dam holders.

6. Apparatus of claim 2 wherein said heavy liquid phase has a higher flow rate than said light liquid phase and the number of said heavy liquid phase dam holders exceeds the number of said light liquid phase dam holders.

7. Apparatus of claim 3 wherein said hub mounts 3 light liquid phase dam holders.

8. Apparatus of claim 5 wherein said hub mounts 4 light liquid phase dam holders and 2 heavy liquid phase dam holders.

9. Apparatus of claim 6 wherein said hub mounts 4 heavy liquid phase dam holders and 2 light liquid phase dam holders.

10. Apparatus of claim 3 wherein said bowl rotates within a stationary housing and said light liquid phase is directed outwardly through bores associated with said light liquid phase dam holders into an inner compartment within said housing, and said heavy liquid phase is directed outwardly through bores associated with said heavy liquid phase dam holders into an outer compartment within said housing.

11. Apparatus of claim 4 wherein said bowl rotates within a stationary housing and said light liquid phase is directed outwardly through bores associated with said heavy liquid phase dam holders into an outer compartment within said housing, and said heavy liquid phase is directed outwardly through bores associated with said light liquid phase dam holders into an inner compartment within said housing.

12. Apparatus of claim 10 wherein baffle means is interposed between said inner and outer compartments for reducing cross-contamination of aerosols formed from respective liquid phases.

13. Apparatus of claim 12 wherein an annular flange is mounted to said hub outwardly said bore means, said flange having a plurality of annular grooves disposed therearound, said baffle means comprises a labyrinth structure including a plurality of partitions, each of said partitions extending from said housing inwardly into one of said grooves in near contact relationship therewith to provide a space therebetween, said partitions forming a chamber centrally said inner and outer compartments.

14. Apparatus of claim 13 wherein said partitions form a heavy liquid phase aerosol compartment adjacent said outer compartment and a light liquid phase aerosol compartment adjacent said inner compartment, said central chamber communicating with both of said aerosol compartments.

15. Apparatus of claim 14 wherein said central chamber drains a mixture of aerosols introduced therein from said light and heavy liquid phase aerosols compartments.

16. Apparatus of claim 14 wherein said central chamber is provided with a pipe for venting thereof.

17. Apparatus of claim 14 wherein said central chamber is provided with a pipe for introducing a positive pressure therein for urging aerosols back into their respective aerosol compartments.

18. Apparatus of claim 17 wherein each outer partition member of said labyrinth structure forms a wall of respective aerosol compartment, each of said walls having an opening for passage of respective aerosol therethrough into respective inner and outer compartments urged by said positive pressure.

19. Apparatus of claim 1 wherein said dam means is interchangeably mounted to said light liquid phase dam holders and said heavy liquid phase dam holders.

20. Apparatus of claim 19 wherein low cresting of liquid phase being separated is effectively controlled by said cut-out passageways of said dam means.

21. Apparatus of claim 1 wherein said screw means is a helical screw conveyor having a series of coiled helical flights mounted thereto, said screw conveyor rotating at a speed slightly different than speed of rotation of said bowl, said apparatus further comprising a scraper tab mounted to a distal portion of forwardmost of said flights for passing outwardly of said underdams to thereby remove solids sedimented thereat for conveying out said rear portion of said bowl.

* * * * *